US009790747B2

(12) United States Patent
Nguyen

(10) Patent No.: US 9,790,747 B2
(45) Date of Patent: Oct. 17, 2017

(54) CONTROL LINE PROTECTION SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 290 days.

(21) Appl. No.: 14/587,850

(22) Filed: Dec. 31, 2014

(65) Prior Publication Data

US 2016/0186502 A1 Jun. 30, 2016

(51) Int. Cl.

| | |
|---|---|
| ***E21B 17/04*** | (2006.01) |
| ***E21B 19/16*** | (2006.01) |
| ***E21B 33/037*** | (2006.01) |
| ***E21B 34/12*** | (2006.01) |
| ***E21B 34/14*** | (2006.01) |
| *E21B 34/00* | (2006.01) |

(52) U.S. Cl.

CPC ..... *E21B 17/04* (2013.01); *E21B 19/16* (2013.01); *E21B 33/037* (2013.01); *E21B 34/12* (2013.01); *E21B 34/14* (2013.01); *E21B 2034/007* (2013.01)

(58) Field of Classification Search

None

See application file for complete search history.

(56) References Cited

U.S. PATENT DOCUMENTS

| | | | | |
|---|---|---|---|---|
| 3,474,857 | A * | 10/1969 | Newman | E21B 33/037 166/368 |
| 5,188,181 | A * | 2/1993 | Brammer | E21B 33/143 166/330 |
| 5,479,989 | A | 1/1996 | Shy et al. | |
| 5,791,418 | A * | 8/1998 | Milberger | E21B 33/043 166/334.4 |
| 6,186,229 | B1 * | 2/2001 | Martin | A61B 5/0472 166/250.08 |
| 2009/0044944 | A1 | 2/2009 | Murray et al. | |
| 2009/0095486 | A1 | 4/2009 | Williamson, Jr. | |

(Continued)

FOREIGN PATENT DOCUMENTS

| | | |
|---|---|---|
| GB | 2218135 A | 11/1989 |
| WO | 99/19602 A2 | 4/1999 |
| WO | 00/53889 A1 | 9/2000 |

OTHER PUBLICATIONS

PCT International Search Report and Written Opinion; Application No. PCT/US2015/065616; Dated May 31, 2016; 17 pages.

(Continued)

*Primary Examiner* — Shane Bomar

(74) *Attorney, Agent, or Firm* — Fletcher Yoder, P.C.

(57) ABSTRACT

A system including a first tubular with a first fluid passage configured to receive a fluid for use in a mineral extraction system, a second tubular surrounding the first tubular, a protective cover coupled to the second tubular with a shear pin, wherein the second tubular is configured to move the protective cover from a first axial position to a second axial position, and the protective cover is configured to form a first seal around the first fluid passage; and a retainer coupled to the first tubular or the protective cover and configured to couple the protective cover to the first tubular.

25 Claims, 7 Drawing Sheets

(56) References Cited

U.S. PATENT DOCUMENTS

| | | | | |
|---|---|---|---|---|
| 2010/0319927 | A1* | 12/2010 | Yokley | E21B 23/04 166/373 |
| 2011/0005774 | A1* | 1/2011 | Sinnott | E21B 33/04 166/380 |
| 2014/0196890 | A1* | 7/2014 | Tom | E21B 43/105 166/208 |

OTHER PUBLICATIONS

PCT Notice of Invitation to Pay Additional Fees; Application No. PCT/US2015/065616; Dated Mar. 23, 2016; 7 pages.

* cited by examiner

CONTROL LINE PROTECTION SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Control lines and other components of a drilling and production system are typically coupled together to provide a fluid path for hydraulic fluid, chemical injections, or the like to pass through the wellhead assembly. The control lines may be formed from hoses and various passages through components of the wellhead assembly, such as a tubing hanger. In operation, fluid is typically routed from an external location (e.g., surface rig) to the wellhead assembly to control equipment. Unfortunately, control line inlets may be exposed to surrounding fluids (e.g., seawater) after removal of certain equipment (e.g., running tool).

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Control lines are used in the drilling and production industry to control downhole operations. For example, control lines may be used to actuate equipment (e.g., open and close valves) or inject fluids. The control lines provide a path for hydraulic control fluid, chemical injection fluid, etc. to be passed through a wellhead assembly. The control lines may be formed with hoses and passages through various pieces of equipment. For example, the control lines may be routed through hoses coupled to a running tool and then through passages in the running tool to other components, such as a control line sub. Unfortunately, once the running tool is removed, an unprotected inlet and/or outlet of a control line may allow surrounding fluids (e.g., seawater) to enter the control line. The disclosed embodiments include a protective cover system (e.g., automatic protective cover system) that blocks undesirable fluid(s) (e.g., seawater, etc.) from entering inlets and/or outlets of control lines when exposed by the removal of equipment (e.g., running tool).

Figure 1:
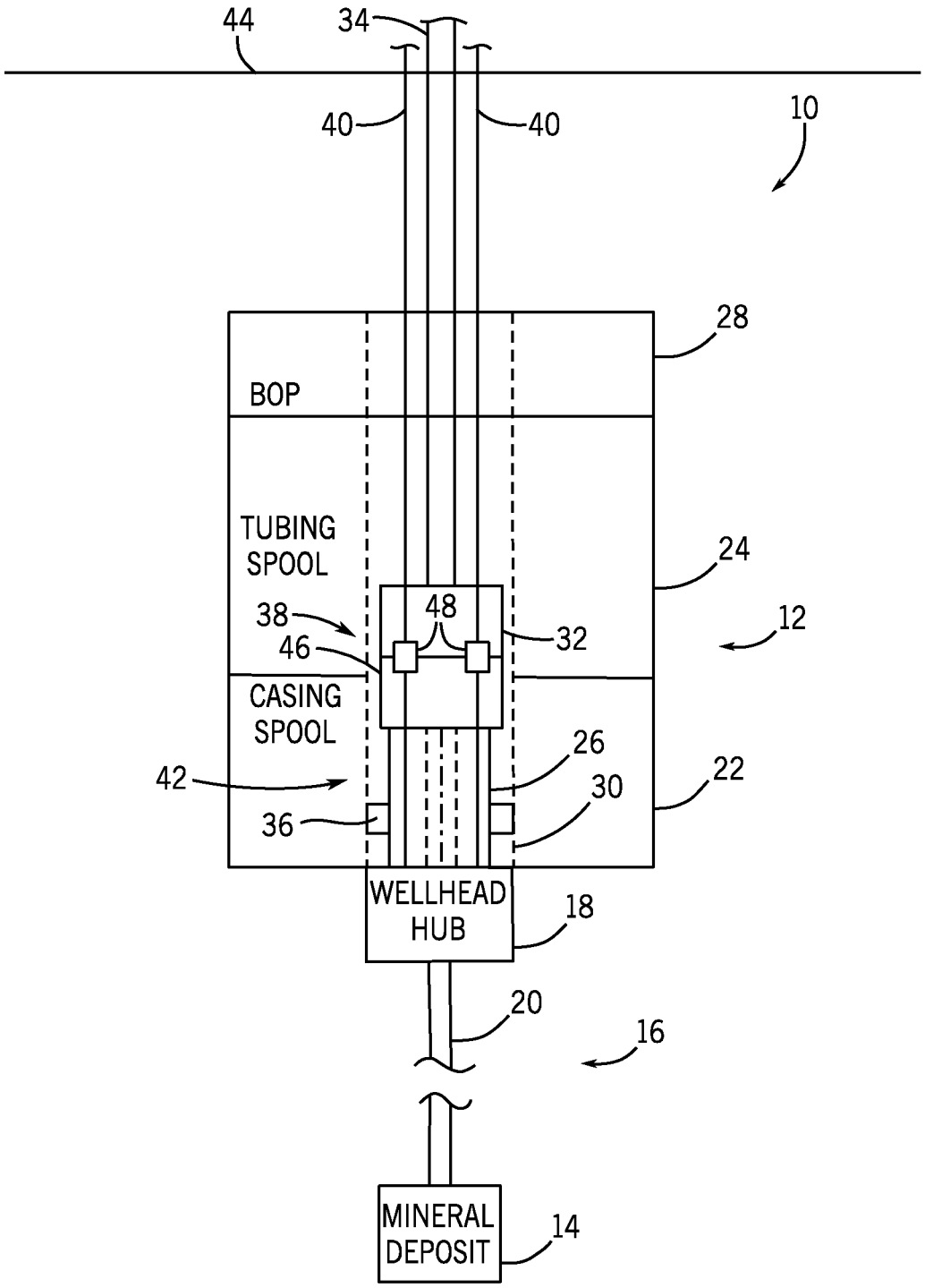
FIG. 1 is a block diagram of an embodiment of a mineral extraction system.

FIG. 1 is a block diagram that illustrates a mineral extraction system 10 (e.g., hydrocarbon extraction system) that can extract various minerals and natural resources, including hydrocarbons (e.g., oil and/or natural gas) from the earth. The mineral extraction system 10 may be land-based (e.g., a surface system) or subsea (e.g., a subsea system). The system 10 includes a wellhead assembly 12 coupled to a mineral deposit 14 via a well 16, wherein the well 16 includes a wellhead hub 18 and a well-bore 20. The wellhead hub 18 includes a large diameter hub at the end of the well-bore 20 that enables the wellhead 12 to couple to the well 16. The wellhead 12 typically includes multiple components that control and regulate activities and conditions associated with the well 16. For example, the wellhead 12 includes a casing spool 22 (e.g., tubular), a tubing spool 24 (e.g., tubular), a hanger 26 (e.g., a tubing hanger or a casing hanger), a blowout preventer (BOP) 28 and a "christmas" tree (not shown).

In operation, the wellhead 12 enables completion and workover procedures, such as tool insertion (e.g., the hanger 26) into the well 16 and the injection of various chemicals into the well 16. Further, minerals extracted from the well 16 (e.g., oil and natural gas) may be regulated and routed via the wellhead 12. For example, the blowout preventer (BOP) 28 or "christmas" tree may include a variety of valves, fittings, and controls to prevent oil, gas, or other fluid from exiting the well 16.

As illustrated, the casing spool 22 defines a bore 30 that enables fluid communication between the wellhead 12 and the well 16. Thus, the casing spool bore 30 may provide access to the well bore 20 for various completion and workover procedures. To emplace the hanger 26 within the casing spool 22, the hydrocarbon extraction system 10 includes a tool 32 (e.g., running tool) coupled to a drill string 34. In operation, the drill string 34 lowers the tool 32 and hanger 26 into the wellhead assembly 12 where the hanger 26 is secured to the casing spool 22 with a lock system 36. Once secured, the tool 32 may facilitate the control of various equipment in the well 20 and/or the wellhead assembly 12 (e.g., valves) using control lines 38. In some embodiments, the control lines 38 may facilitate chemical injection into the well 20. As explained above, the control lines may be formed with hoses 40 and passages 42 through various pieces of drilling components. For example, the control lines 38 may be routed from the surface 44 through hoses 40 coupled to the running tool 32. The running tool 32 may then direct fluid through passages 42 in the running tool 32, a control line sub 46, and hanger 26. As will be explained in detail below, in order to block undesirable fluid from entering the control lines 38, the running tool 32 may include a protective cover system 48 that automatically covers the inlets and/or outlets of passages in equipment (e.g., passages in the control line sub 46) as the running tool 32 retracts.

Figure 2:
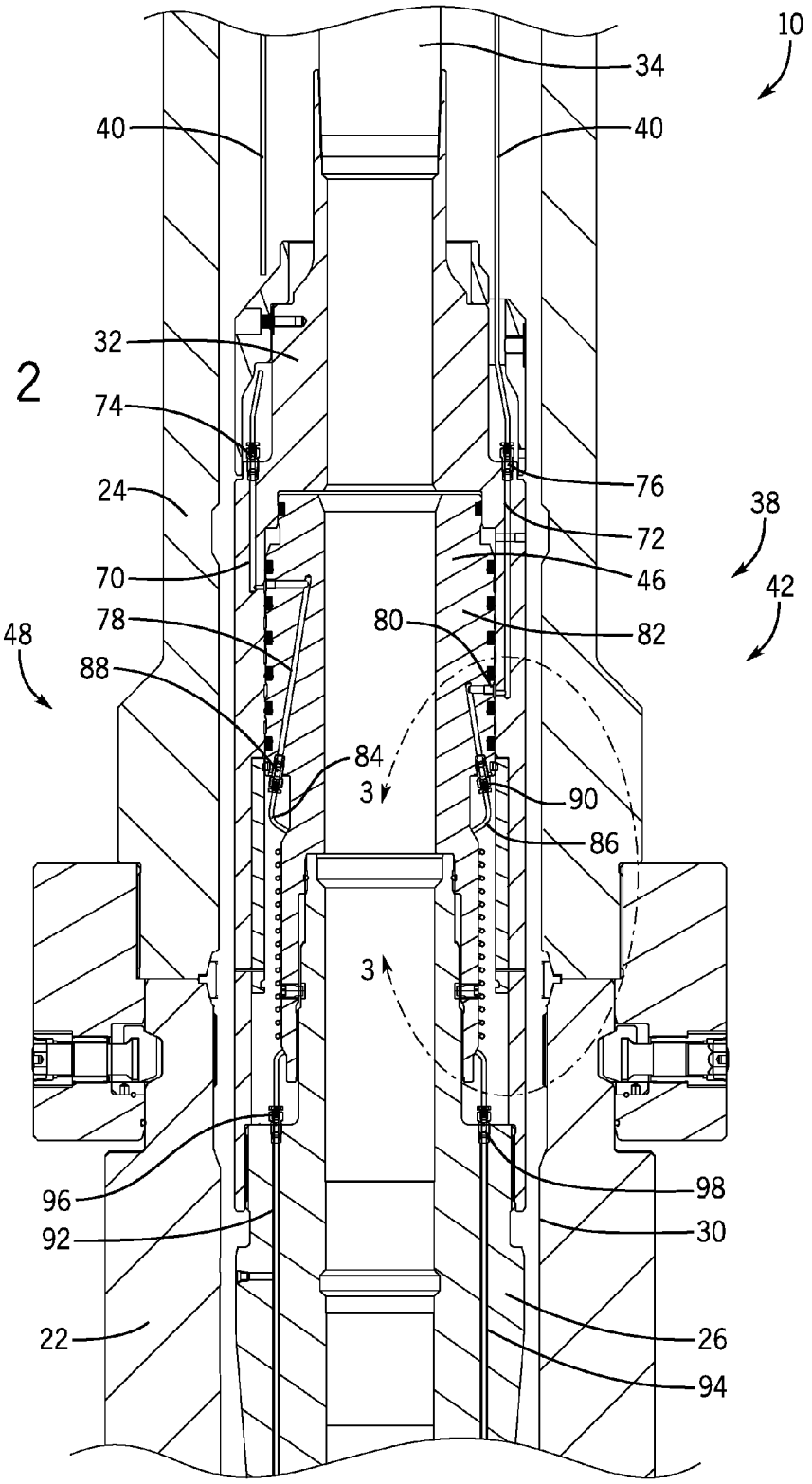
FIG. 2 is a cross-sectional view of an embodiment of a mineral extraction system with a protective cover system in an unenergized state.

FIG. 2 is a cross-sectional view of a mineral extraction system 10 with the protective cover system 48 in an unenergized state. As illustrated, the running tool 32 couples to the control line sub 46, which couples to the tubing hanger 26. Together the running tool 32, control line sub 46, and tubing hanger enable fluid (e.g., hydraulic, chemical, etc.) to pass through the wellhead assembly 12 to control downhole equipment (e.g., valves) or enable chemical injection into the well 20. For example, the running tool 32 may include one or more fluid passages 70, 72 that couple to the hoses 40 with connectors 72, 74. The fluid passages 70, 72 in turn fluidly couple with fluid passages 78, 80 in the control line sub 46. As will be explained in detail below, the fluid passages 70, 72 in the running tool 32 align with the fluid passages 78, 80 in the control line sub 46 when the running tool 32 and control line sub 46 are coupled together. However, when the running tool 32 disconnects from the control line sub 46, the fluid passages 70, 72 misalign with the fluid passages 78, 80 blocking hydraulic control or chemical injection. As illustrated, the fluid passages 78, 80 may extend through the body 82 of the control line sub 46 before coupling to hoses 84, 86 with connectors 88, 90. The hoses 84, 86 may then circumferentially wrap around the body 82 of the control line sub 46 before coupling to fluid passages 92, 94 in the hanger 26 with connectors 96 and 98. In this way, fluid (e.g., hydraulic, chemical) and/or pressure flows from a fluid source into the wellhead assembly 12 or well 20 to control downhole components or enable chemical injection, which may increase the release of hydrocarbons.

Figure 3:
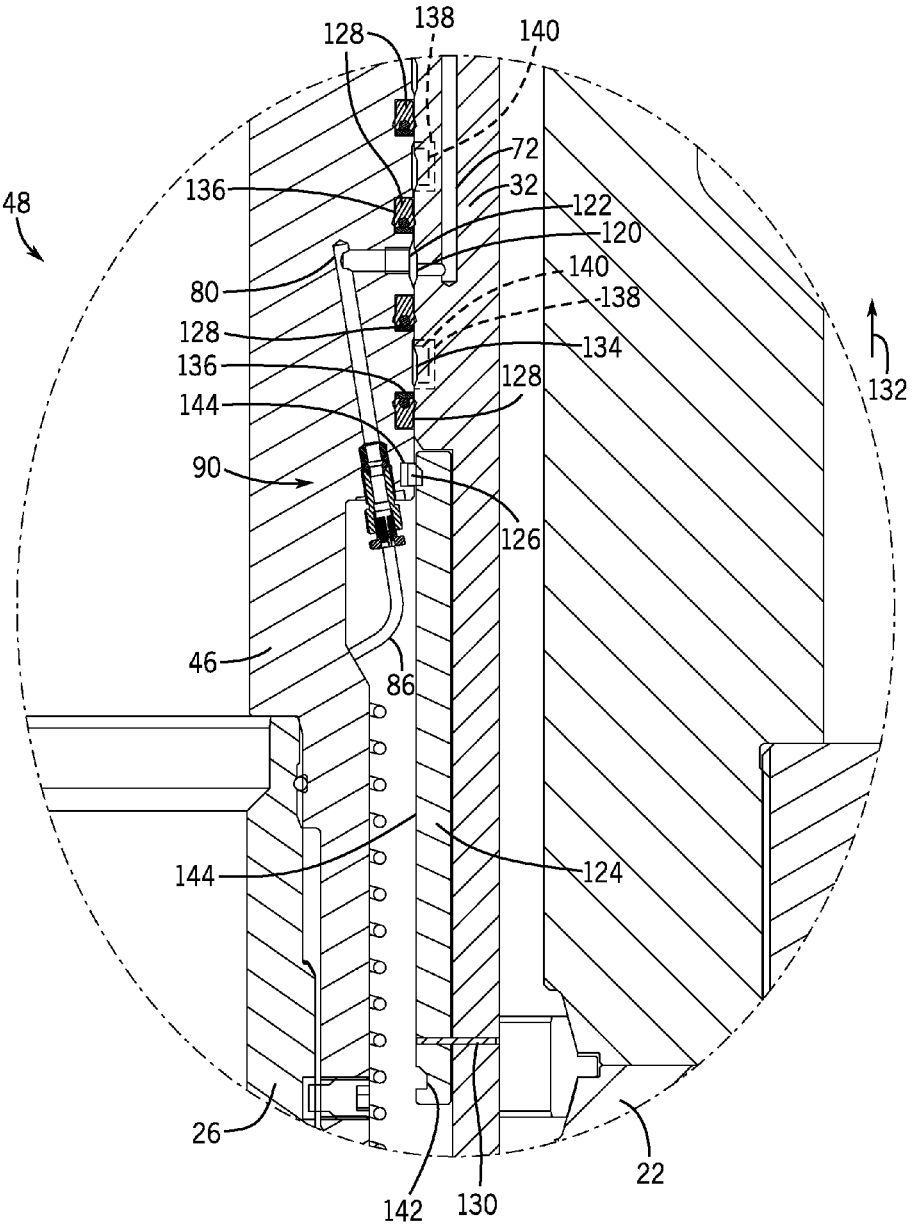
FIG. 3 is a partial cross-sectional view of an embodiment of the mineral extraction system with a protective cover system in an unenergized state within line 3-3 of FIG. 2.

FIG. 3 is a sectional view of the mineral extraction system 10 with a protective cover system 48 in an unenergized state within line 3-3 of FIG. 2. As explained above, the fluid passages 70, 72 in the running tool 32 align with the fluid passages 78, 80 in the control line sub 46 when the running tool 32 and control line sub 46 are coupled together. More specifically, when an outlet 120 of the fluid passage 72 aligns with an inlet 122 of the fluid passage 80, fluid is able to flow between the fluid passages 72 and 80. However, when the running tool 32 disconnects from the control line sub 46, the inlet 122 of the fluid passage 80 may be exposed to surrounding fluid in the wellhead assembly 12. Accordingly, the mineral extraction system 10 includes the protective cover system 48 that blocks fluid from entering the fluid inlet 22, and therefore from entering the various passages and hoses in the control line sub 46 and hanger 26.

The protective cover system 48 includes a protective cover 124, a retainer 126 (e.g., annular), and seals 128 (e.g., annular). Together the cover 124, retainer 126, and seals 128 form a seal around the inlet 122 to block the flow of fluid into the passage 80. As illustrated, the protective cover 124 couples to the running tool 32 with a shear pin 130. When the running tool 32 is coupled to the control line sub 46, the protective cover 124 is in a first axial position that is axially offset from the inlet 122 of the passage 80. However, as the running tool 32 disconnects and moves in direction 132, the running tool 32 axially moves the protective cover 124, with the shear pin 130, in direction 132 to cover the inlet 122. In some embodiments, the protective cover 124 may be an annular sleeve that wraps around an exterior surface 134 of the control line sub 46 to block fluid access to the inlet 122 with the seals 128. The seals 128 may likewise be annular and rest within grooves 136 that extend circumferentially about the exterior surface 134 of the control line sub 46. In some embodiments, the grooves 136 may be circular in order to only surround the inlet 122. Moreover, in some embodiments, the protective cover 124 may include grooves 138 that receive seals 140 to block fluid from entering the inlet 122; instead of or in addition to the seals 128. In other embodiments, the protective cover 124 and control line sub 46 may use seals (e.g., seals 128 and 140) to block fluid flow into the inlet 122 after removal of the running tool 32.

In order to block removal of the protective cover 124 out of the wellhead assembly 12 as the running tool 32 retracts, the protective cover 124 includes one or more grooves 142 (e.g., 1, 2, 3, 4, 5, etc.) on an interior surface 144. In operation, the groove 142 couples to the retainer 126 to block retraction of the protective cover 124 as the running block 32 moves in axial direction 132. The retainer 126 may be a ring (e.g., c-ring) or one or more pins that can be compressed inside of the groove(s) 142 (e.g., annular groove) until the protective cover 124 axially aligns with the retainer 126. Once aligned, the retainer 126 may project into the groove(s) 142 blocking further axial movement of the protective cover 124. As the running tool 32 continues to retract, the retainer 126 blocks movement of the protective cover 124 enabling the running tool 32 to shear through the shear pin 130 leaving the protective cover 124 coupled to the control line sub 46, around the inlet 122. It should be understood that in some embodiments, the protective cover 124 may include the retainer 126, which engages a groove on the control line sub 46 to block further axial movement of the protective cover 124 in axial direction 132.

Figure 4:
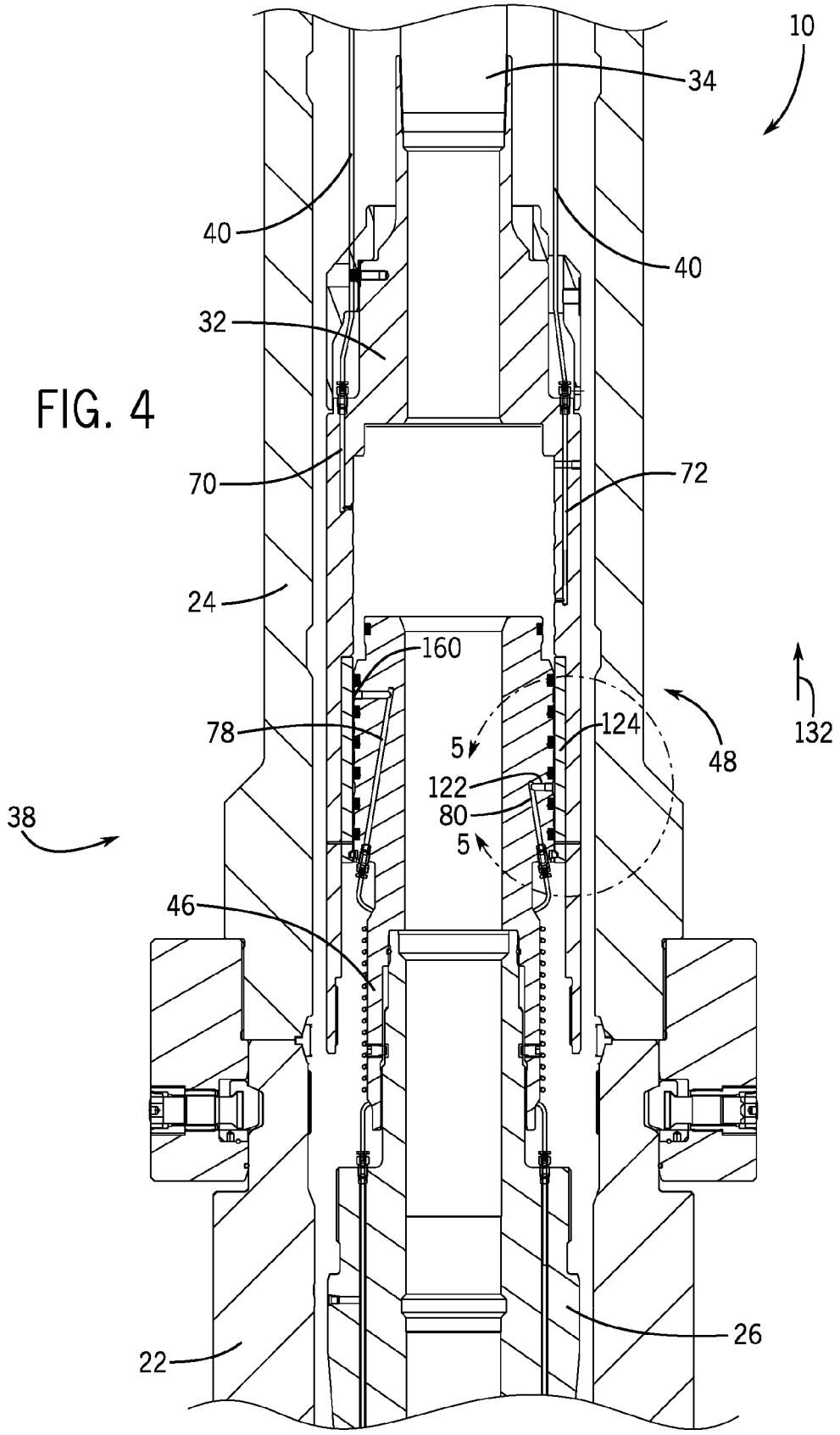
FIG. 4 is a cross-sectional view of an embodiment of a mineral extraction system with a protective cover system in an energized state.

FIG. 4 is a cross-sectional view of a mineral extraction system 10 with the protective cover system 48 in an energized state. As illustrated, the running tool 32 has separated from the control line sub 46, misaligning the fluid passages 70, 72 in the running tool 32 with the fluid passages 78 and 80 in the control line sub 46. As explained above, as the running tool 32 separates from the control line sub 46 and moves in axial direction 132, the running tool 32 transitions the protective cover 124 from the first axial position to the second axial position. In the second axial position, the protective cover 124 covers the inlets 122 and 160 of the fluid passages 78 and 80, blocking undesirable fluid flow into the passages 78, 80.

Figure 5:
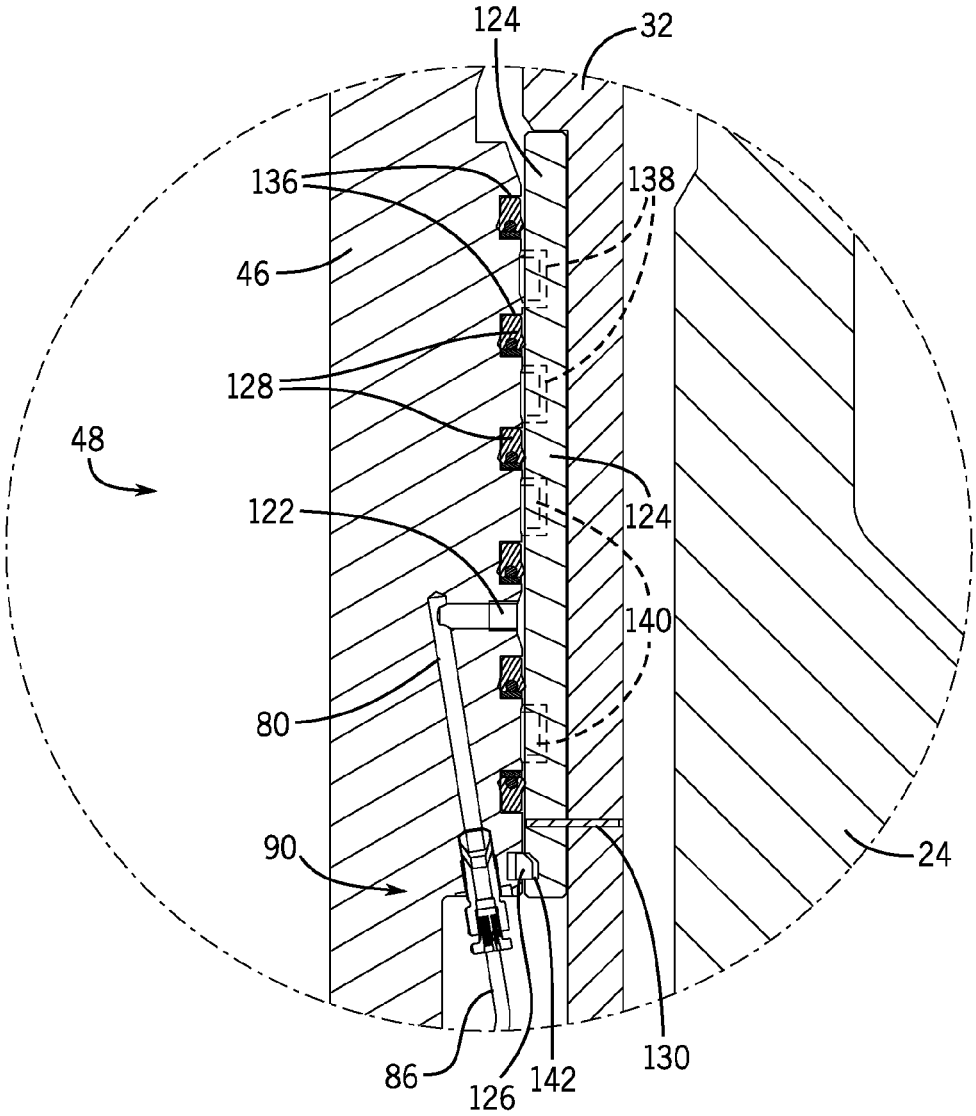
FIG. 5 is a partial cross-sectional view of an embodiment of the mineral extraction system with a protective cover system in an energized state within line 5-5 of FIG. 4.

FIG. 5 is a sectional view of the mineral extraction system 10 with a protective cover system 48 in an energized state within line 5-5 of FIG. 4. In the second axial position, the protective cover 124 covers the inlet 122 in the second axial position, blocking fluid from entering the fluid passage 80 with the seals 128. In some embodiments, the protective cover 124 may include the apertures 138 with seals 140; instead of using seals 128 on the control line sub 46. As illustrated, the protective cover 124 and/or control line sub 46 may include multiple seals 128, 140 to provide redundant sealing around the inlet 122, or the multiple seals 128, 140 may enable sealing around other fluid passages through the control line sub 46. For example, each set of seals 128 or 140 may seal around a respective inlet or outlet of a fluid passage in the control line sub 46.

Figure 6:
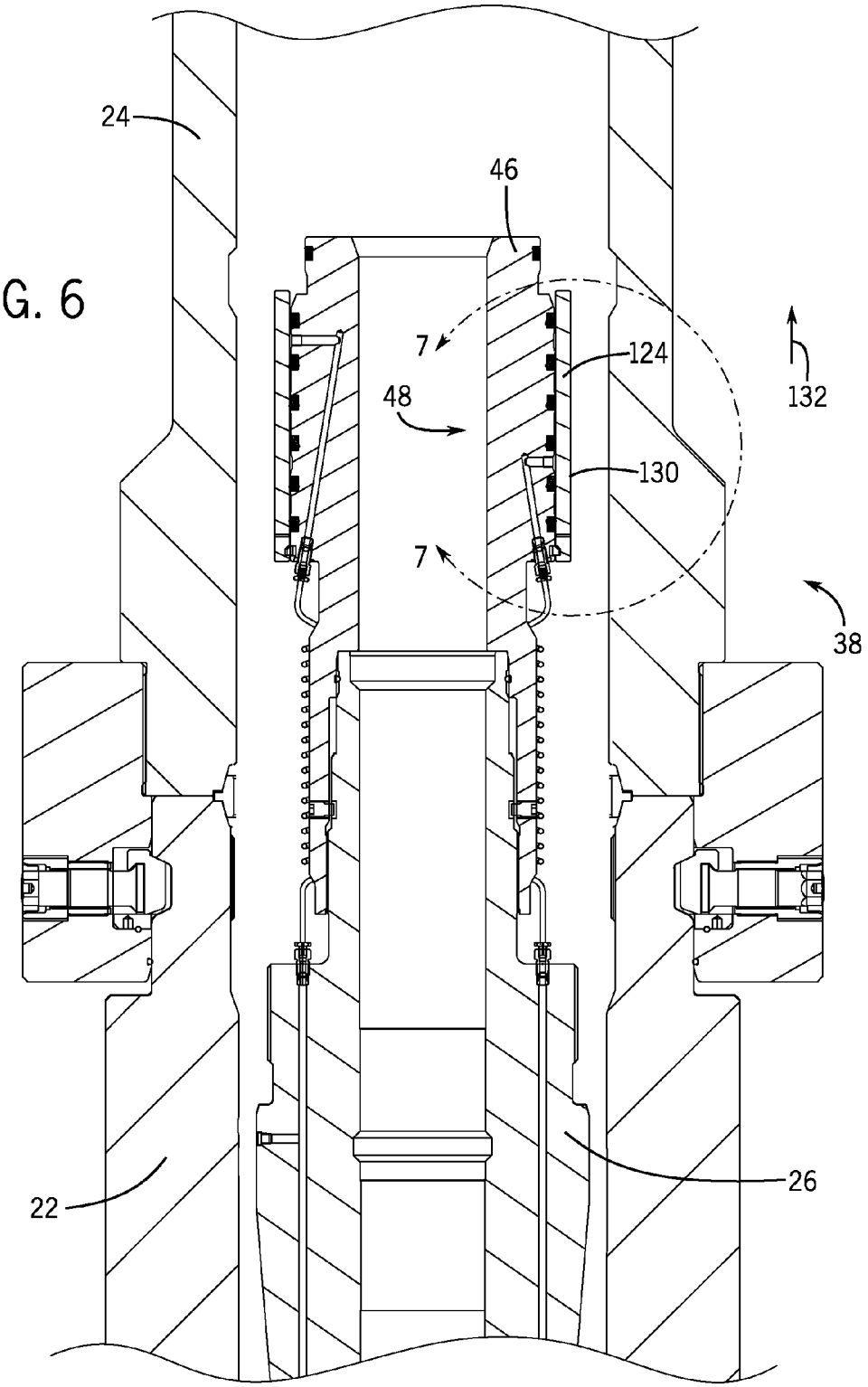
FIG. 6 is a cross-sectional view of an embodiment of a mineral extraction system without a running tool.
Figure 7:
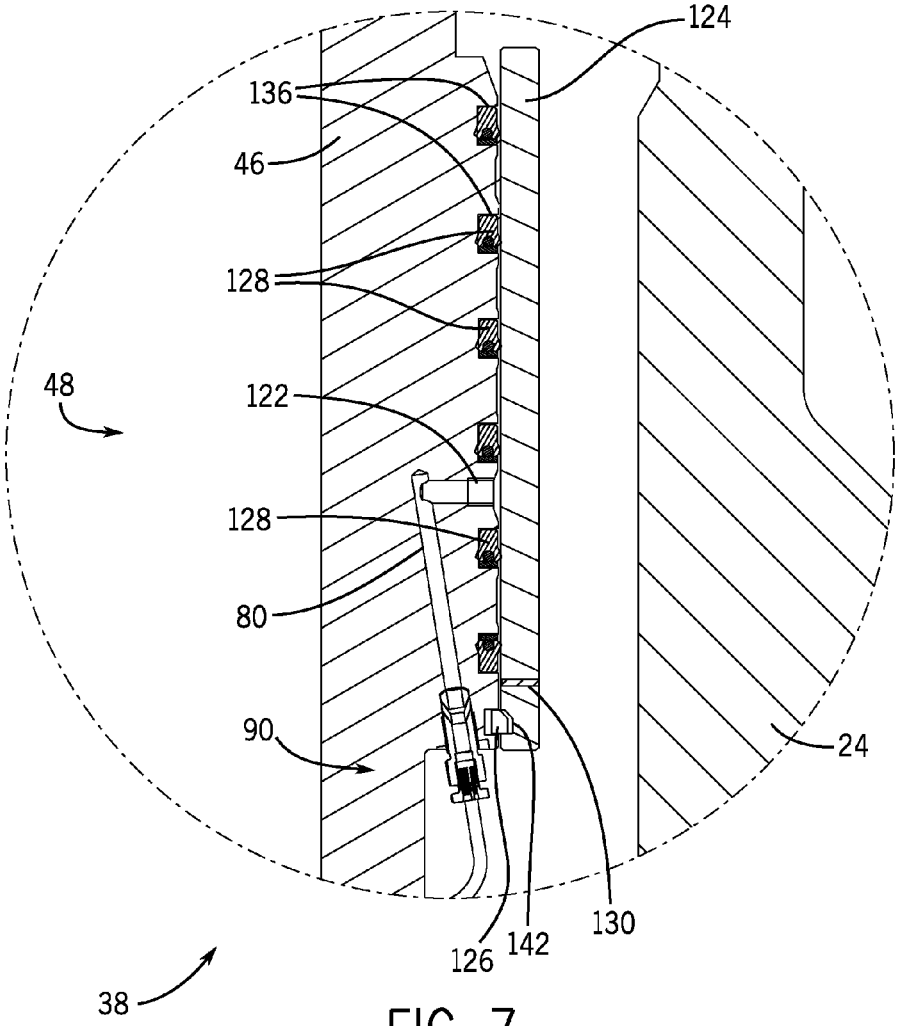
FIG. 7 is a partial cross-sectional view of an embodiment of the mineral extraction system with a protective cover system in an energized state within line 7-7 of FIG. 6.

FIGS. 6 and 7 are cross-sectional views of a mineral extraction system 10 without a running tool 32. As explained above, after moving the protective cover 124 from the first axial position to the second axial position, further axial movement of the running tool 32 enables the running tool 32 to shear through the shear pin 130. The running tool 32 may then be pulled out of the wellhead assembly 12, leaving the protective cover 124 coupled to the control line sub 46.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a mineral extraction system, comprising:

a first tubular comprising a first control fluid passage with a first fluid inlet;

a second tubular comprising a second control fluid passage with a first fluid outlet, wherein the second control fluid passage is configured to fluidly couple to the first control fluid passage to supply a control fluid when the second tubular is in a first axial position;

a protective cover system configured to protect the control fluid in the first control fluid passage, comprising:

a protective cover; and one or more seals on the first tubular or the protective cover;

wherein the second tubular couples to the protective cover and is configured to move the protective cover into a sealing position around the first fluid inlet when the second tubular moves along an axial path of travel from the first axial position to a second axial position, wherein the sealing position of the protective cover blocks undesirable fluids from entering the first control fluid passage.

2. The system of claim 1, wherein the protective cover system includes a retainer that couples the protective cover to the first tubular, and the retainer comprises first and second retainer portions that abut one another in an axial direction relative to the axial path of travel.

3. The system of claim 1, wherein the protective cover system includes a retainer that couples the protective cover to the first tubular, and the retainer comprises a retaining ring that couples to an annular groove on the protective cover or the first tubular.

4. The system of claim 1, wherein the protective cover system includes a retainer that couples the protective cover to the first tubular, and the retainer comprises a pin that couples to a groove on the protective cover or the first tubular.

5. The system of claim 1, wherein the protective cover comprises an annular sleeve.

6. The system of claim 1, wherein the protective cover couples to the second tubular with a shear pin, the protective cover is configured to move to the sealing position around the first fluid inlet in response to movement of a tool, and the shear pin is configured to shear during retrieval of the tool such that the protective cover remains in the sealing position.

7. The system of claim 1, wherein the first tubular comprises a third control fluid passage with a second fluid inlet, and the first fluid inlet and the second fluid inlet are at different axial positions on the first tubular.

8. The system of claim 7, wherein the protective cover is configured to seal the first and second fluid inlets.

9. The system of claim 1, wherein the first control fluid passage is configured to inject chemicals as the control fluid into a well.

10. The system of claim 1, wherein the first control fluid passage is configured to supply a hydraulic fluid as the control fluid to actuate a hydraulic component.

11. The system of claim 1, wherein the one or more seals are disposed on the first tubular, the protective cover, or a combination thereof.

12. The system of claim 1, comprising a tool coupled to the second tubular, wherein the tool is configured to supply the control fluid through the first and second control fluid passages when the second tubular is in the first axial position, the tool is configured to move the second tubular to the second axial position moving the protective cover into the sealing position, and the tool is configured to be retrieved after the protective cover is moved into the sealing position.

13. A system, comprising:

a first tubular comprising a first fluid passage and a second fluid passage configured to receive one or more fluids for use in a mineral extraction system;

a second tubular surrounding the first tubular;

a protective cover coupled to the second tubular, wherein the second tubular is configured to move the protective cover from a first axial position to a second axial position, and the protective cover is configured to form a first seal around the first fluid passage and a second seal around the second fluid passage; and a retainer coupled to the first tubular or the protective cover and configured to couple the protective cover to the first tubular.

14. The system of claim 13, wherein the retainer comprises a retaining ring that couples to an annular groove on the protective cover or the first tubular.

15. The system of claim 13, wherein the retainer comprises a pin that couples to a groove on the protective cover or the first tubular.

16. The system of claim 13, wherein the protective cover comprises an annular sleeve.

17. The system of claim 13, wherein the first fluid passage comprises a first control fluid passage and the second fluid passage comprises a second control fluid passage.

18. The system of claim 13, comprising a tool coupled to the second tubular, wherein the tool is configured to supply the one or more fluids through the first and second fluid passages when the protective cover is in the first axial position, the tool is configured to move the protective cover from the first axial position to the second axial position to form the first and second seals, and the tool is configured to be retrieved after the protective cover forms the first and second seals.

19. The system of claim 18, wherein the protective cover is coupled to the second tubular with a shear structure, and the shear structure is configured to shear to enable retrieval of the tool while the first and second seals block entry of undesirable fluids into the first and second fluid passages.

20. A method, comprising:

moving a protective cover between a first axial position and a second axial position via movement of a first tubular coupled to a tool along an axial path of travel, wherein the tool, the first tubular, or a combination thereof, comprises one or more first control fluid passages;

enabling flow of a control fluid between the one or more first control fluid passages and one or more second control fluid passages in a second tubular in the first axial position of the protective cover; and sealing the one or more second control fluid passage in the second tubular in the second axial position of the protective cover, wherein sealing comprises blocking undesirable fluids from entering the one or more second control fluid passages.

21. The method of claim 20, wherein enabling flow of the control fluid comprises supplying chemicals as the control fluid into a well, or supplying a hydraulic fluid as the control fluid to actuate a hydraulic component, or a combination thereof.

22. The method of claim 20, comprising coupling the protective cover to the second tubular with a retainer on the protective cover or the second tubular that engages a recess on the protective cover or the second tubular.

23. The method of claim 20, wherein sealing the one or more control fluid passages comprises sealing with a first seal around a first control fluid passage and sealing with a second seal around a second control fluid passage in the second axial position of the protective cover.

24. The method of claim 20, wherein enabling flow of the control fluid occurs while the tool is coupled to the first tubular, wherein sealing the one or more second control fluid passage occurs prior to retrieval of the tool.

25. The method of claim 24, comprising shearing through a shear structure to enable separation and retrieval of the tool, leaving the protective cover in the second axial position to block undesirable fluids from entering the one or more second control fluid passages.

* * * * *